US007918445B2

(12) United States Patent
Okamoto

(10) Patent No.: US 7,918,445 B2
(45) Date of Patent: Apr. 5, 2011

(54) SHEET FEEDING DEVICE AND IMAGE FORMING APPARATUS

(75) Inventor: Tsugio Okamoto, Gifu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 98 days.

(21) Appl. No.: 12/411,641

(22) Filed: Mar. 26, 2009

(65) Prior Publication Data

US 2009/0243192 A1 Oct. 1, 2009

(30) Foreign Application Priority Data

Mar. 26, 2008 (JP) ..... 2008-080625

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | |
|---|---|---|---|
| 2005/0023744 | A1 | 2/2005 | Okamoto |
| 2006/0180986 | A1 | 8/2006 | Hattori |
| 2007/0140768 | A1 | 6/2007 | Yoshida |

FOREIGN PATENT DOCUMENTS

| | | |
|---|---|---|
| JP | 57-199233 | 6/1956 |
| JP | 55-027255 | 2/1980 |
| JP | 58-048639 | 4/1983 |
| JP | 58-162445 | 9/1983 |
| JP | 61-002339 | 1/1986 |
| JP | 04-051436 | 4/1992 |
| JP | 04-109940 | 9/1992 |
| JP | 05-105253 | 4/1993 |
| JP | 2002-302281 | 10/2002 |
| JP | 2006-176321 | 7/2006 |
| JP | 3864936 | 10/2006 |
| JP | 2007-168955 | 7/2007 |
| JP | 2008-030697 | 2/2008 |

OTHER PUBLICATIONS

Japanese Office Action received for counterpart JP Application No. 2008-080625, mailed Jan. 26, 2010.

*Primary Examiner* — David H Bollinger
(74) *Attorney, Agent, or Firm* — Banner & Witcoff, Ltd.

(57) ABSTRACT

A sheet feeding device to feed a sheet in a sheet stack into a sheet feeding path is provided. the sheet feeding device includes a feed roller configured to contact the sheet stack and feed the sheet in a feeding direction, a guide member, having a guide surface, which is configured to contact a side of the sheet fed by the feeding roller, to guide the sheet being fed along a guiding direction, and a shifting unit to shift the feed roller in a direction toward the guide surface before the feed roller is rotated.

22 Claims, 5 Drawing Sheets

SHEET FEEDING DEVICE AND IMAGE FORMING APPARATUS

CROSS REFERENCE TO RELATED APPLICATION

This application claims priority from Japanese Patent Application No. 2008-080625 filed on Mar. 26, 2008, the entire subject matter of which is incorporated herein by reference.

BACKGROUND

1. Technical Field

An aspect of the present invention relates to a sheet feeding device having a roller to pick up a sheet from a sheet stack to feed in a sheet feeding path and an image forming apparatus having the sheet feeding device.

2. Related Art

Conventionally, a sheet feeding device having a roller to pick up a topmost sheet from a stack of sheets in, for example, an image forming apparatus has been known. In the sheet feeding device, a feed roller is provided in a position to become in contact with the sheet stack, and as the roller rotates, the topmost sheet in the stack is separated from the rest of the stack and fed in the sheet feeding path. Further, the sheet feeding device may be provided with a side guide, with which a side of the recording sheet becomes in contact so that the picked up sheet is guided in the sheet feeding path. In a sheet feeding device disclosed in Japanese Patent Publication No. 3864936, for example, a feed roller is angled toward the side guide with respect to a direction of the sheet to be carried so that the sheet is urged to the side guide and steadily let in the sheet feeding path in a correct posture.

SUMMARY

When the recording sheet is picked up from the sheet stack and fed in the sheet feeding path, more than one recording sheets may be picked up by the feed roller due to friction and static clings caused in between the sheets. Therefore, in the above-referenced sheet feeding device, a lower side of the recording sheet picked up by the feed roller is rubbed onto a frictional member so that the following sheets can be seized by the frictional member and separated from the topmost sheet.

In the above sheet feeding device, however, the sheets may not always be separated steadily depending on materials, qualities, and conditions of the cuts.

In view of the above drawbacks, the present invention is advantageous in that a sheet feeding device with a side guide capable of preventing a plurality of overlaid sheets from being fed and an image forming apparatus having the sheet feeding device are provided.

According to an aspect of the present invention, a sheet feeding device to feed a sheet in a sheet stack into a sheet feeding path is provided. The sheet feeding device includes a feed roller configured to contact the sheet stack and feed the sheet in a feeding direction, a guide member, having a guide surface, which is configured to contact a side of the sheet fed by the feeding roller, to guide the sheet being fed along a guiding direction, and a shifting unit to shift the feed roller in a direction toward the guide surface before the feed roller is rotated.

According to the above configuration, the side of the sheet being fed by the feed roller is urged to the guide surface of the guide member, and the feed roller is shifted toward the guide surface before the feed roller starts being rotated. In this regard, a topmost sheet can be urged toward the guide surface by the feed roller, distinctly separated from the sheet stack, and fed in the sheet feeding path.

According to another aspect of the present invention, an image forming apparatus is provided. The image forming apparatus includes a sheet feeding device to feed a sheet in a sheet stack into a sheet feeding path, and an image forming unit to form the image on the sheet being fed by the sheet feeding device, The sheet feeding device includes a feed roller configured to contact the sheet stack and feed the sheet in a feeding direction, a guide member, having a guide surface, which is configured to contact a side of the sheet fed by the feeding roller, to guide the sheet being fed along a guiding direction, and a shifting unit to shift the feed roller in a direction toward the guide surface before the feed roller is rotated.

According to the above configuration, a topmost sheet can be urged toward the guide surface by the feed roller and distinctly separated from the sheet stack so that the topmost sheet can be fed in the sheet feeding path and the image can be formed thereon.

BRIEF DESCRIPTION OF THE ACCOMPANYING DRAWINGS

DETAILED DESCRIPTION

Figure 1:
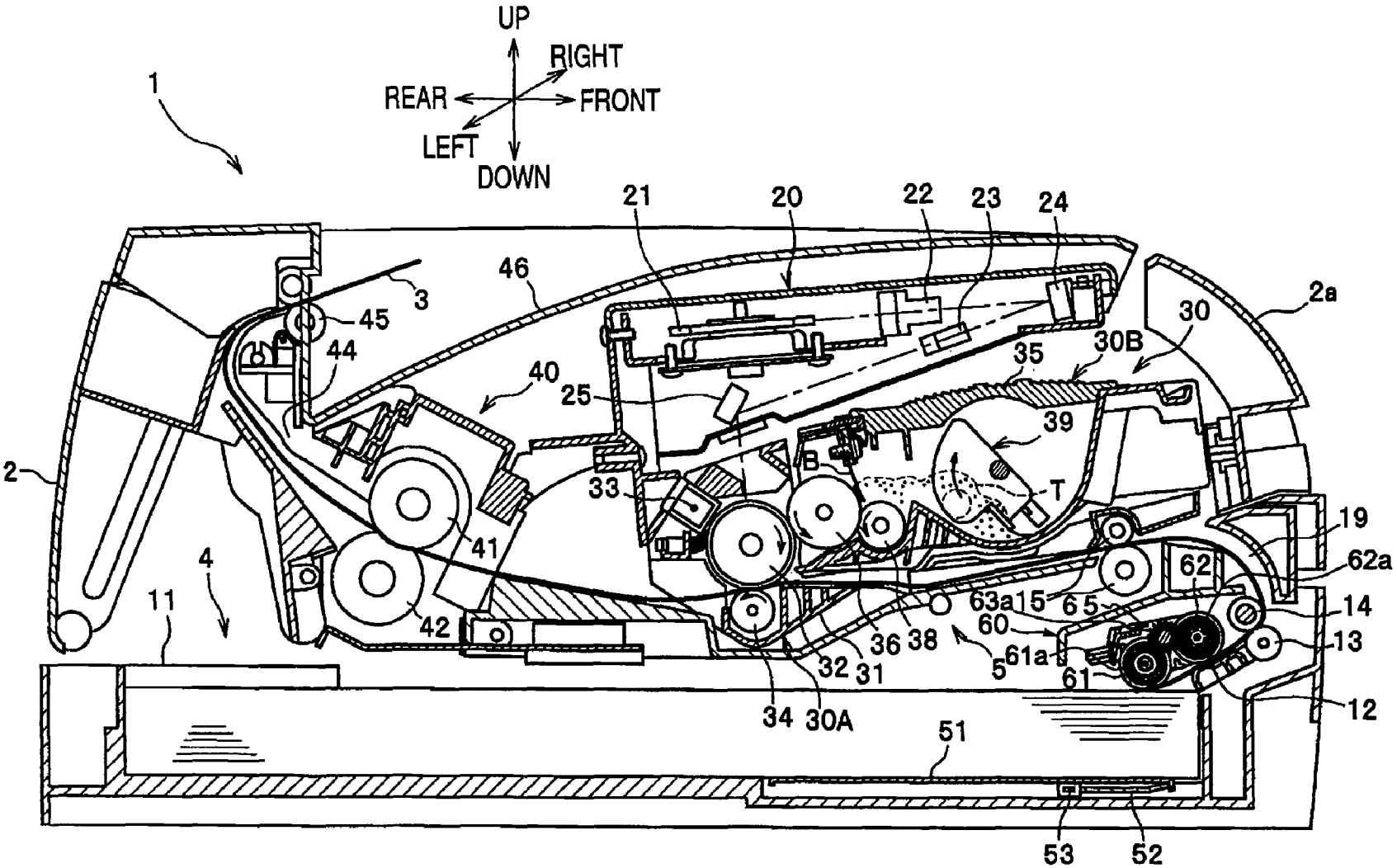
FIG. 1 is a cross-sectional side view of a laser printer according to an embodiment of the present invention.

Hereinafter, an embodiment according to an aspect of the present invention will be described with reference to the accompanying drawings. FIG. 1 is a cross-sectional side view of a laser printer 1 according to an embodiment of the present invention. In FIG. 1, a right-hand side is referred to as front of the laser printer 1, and a left-hand side is referred to as rear of the laser printer 1. Further, a near side and a far side are respectively referred to as left and right of the laser printer 1.

Overall configuration of the laser printer 1 according to the present embodiment will be described. The laser printer 1 includes a feeder unit 4 to feed a recording sheet 3, an image forming unit 5 to form an image on the recording sheet 3, and a casing 2 in which the feeder unit 4, the image forming unit 5, and other components are stored. On a front side of the casing 2, an openable/closable front cover 2*a* is provided. The front cover 2*a* covers an opening in which a process cartridge 30 is removably set. Configuration of the process cartridge 30 will be described later in detail.

The feeder unit 4 includes a sheet tray 11, a holder plate 51, and a lifter plate 52. The sheet tray 11 is removably attached to a bottom portion of the casing 2. A stack of recording sheets 3 is placed in the sheet tray 11. The holder plate 51 is provided to hold the recording sheets 3 in a position to be fed in the sheet tray 11 and is pivotable about a rear end thereof. The lifter plate 52 is provided underneath the holder plate 51 to uplift the holder plate 51. The lifter plate 52 is pivotably attached to the bottom of the sheet tray 11 at a rear end 53 thereof. The lifter plate 52 can be pivoted about the rear end 53 by driving force provided by a main body of the laser printer 1 from a ready position (FIG. 1). Thus, a front portion of the holder plate 51 is uplifted by the lifter plate 52, and the front portion of the recording sheets in the sheet tray 11 is uplifted accordingly. The configuration of the lifter plate 52 is known and disclosed in, for example, Japanese Patent Provisional Publication No. 2006-176321. In the present embodiment, the main body refers to the laser printer 1 excluding the sheet tray 11 and components included in the sheet tray 11.

The feeder unit 4 further includes a feed roller 61, which is provided above the front end of the sheet feed tray 11, and a separator roller 62 in a position nearer to the front with respect to the feed roller 61. The feed roller 61 is in a position to be in contact with a topmost recording sheet 3 in the uplifted sheet stack in the sheet tray 11. The separator roller 62 is arranged to mutually abut a separator pad 12, which is a piece made of a material with resiliency. The separator pad 12 is provided with expanding force by a spring (not shown) and presses the recording sheet 3 being carried by the separator roller 62 on a surface opposite from a surface being in contact with an outer peripheral surface of the separator roller 62.

Thus, the recording sheet 3 picked up by the feed roller 61 is nipped between the separator roller 62 and the separator pad 12 to be separated by friction occurring therebetween from a successive recording sheet which may otherwise be carried along with the recording sheet 3. The feeder unit 4 further includes a dust remover roller 13 and a paired roller 14, which are arranged to oppose to each other. The recording sheet 3 is carried between the dust remover roller 13 and the paired roller 14 and turned an orientation thereof toward the rear of the laser printer 1 along the sheet feeding path 19. Further, a pair of register rollers 15 is provided in the sheet feeding path 19 approximately above the feed roller 61. The recording sheet 3 is thus forwarded to the image forming unit 5.

The image forming unit 5 provided approximately above the feeder unit 4 in the casing 2 includes a scanner unit 20, a process cartridge 30, and a fixing unit 40 and forms an image on a surface of the recording sheet 3 electrophotgraphically.

The scanner unit 20 is disposed at an upper portion inside the casing 2, and includes a laser emitter (not shown), a rotatable polygon mirror 21, lenses 22 and 23, and reflecting mirrors 24, 25. Laser beam emitted from the laser emitter according to predetermined image data is reflected by or transmitted through the polygon mirror 21, the lens 22, the reflecting mirror 24, the lens 23, and the reflecting mirror 25 as shown in a dotted chain line in FIG. 1. The transmitted laser beam is thus irradiated to scan a surface of a photosensitive drum 23 in the process unit at a high speed.

The process cartridge 30, which can be detached from the casing 2, is disposed approximately below the scanner unit 20 and includes a drum cartridge 30A, which holds a photosensitive drum 32 therein, and a toner cartridge 30B, which is removably attached to the photosensitive drum cartridge 30A and contains toner T therein.

The drum cartridge 30A is provided with a case 31, in which the photosensitive drum 32, a scorotoron charger 33, and a transfer roller 34 are housed. The toner cartridge 30B is provided with a toner case 35, in which a developing agent (i.e., toner T) is contained, a developing roller 36, a toner supplier roller 38, and an agitator 39.

The toner T in the toner case 35 is agitated by the agitator 39 and supplied to the developing roller 36 as the toner supplier roller 38 rotates in a direction indicated by an arrow in FIG. 1 (i.e., the counterclockwise direction). Between the toner supplier roller 38 and the developing roller 36, the toner T being transferred is frictionally charged positively and carried according to rotation of the developing roller in a direction indicated by an arrow (i.e., the clockwise direction) to a portion between a toner thickness adjusting blade B and the developing roller 36 in which the toner is further and substantially charged. Thus, the toner is evenly applied over the surface of the developing roller 36 to form a thin layer.

The photosensitive drum 32 is provided to be rotatable in the counterclockwise direction and arranged in parallel with and to be in contact with the developing roller 36. The photosensitive drum 32 includes a drum body (not shown), which is grounded, and a positively chargeable photosensitive layer (not shown) to cover the drum body.

The scorotoron charger 33 is arranged approximately above the photosensitive drum 32 in a position to be substantially apart from the photosensitive drum 32. The scorotoron charger 33 is a corona charger which electrically discharges through electrically charging wires (not shown). The surface of the photosensitive drum 32 is uniformly charged with positive polarity to a predetermined level by the scorotoron charger 33.

The transfer roller 34 is arranged immediately below the photosensitive drum 32 to be in parallel with the rotation axis of the photoconductive drum 32 and is supported by the drum case 31 rotatably to rotate in the counterclockwise direction. The transfer roller 34 includes a rotation shaft (not shown) made of a metal and a roller layer (not shown) made of conductive rubber to cover the rotation shaft. On the surface of the transfer roller 34, a predetermined level of transfer bias of a reverse polarity to the photosensitive drum 32 is applied so that the toner image developed on the surface of the photosensitive drum 32 is transferred to the surface of the recording sheet 3 to form the normal image when the recording sheet 3 is carried in between the photosensitive drum 32 and the transfer roller 34.

The surface of the photosensitive drum 32 is exposed to laser beam that scans the surface of the photosensitive drum 32 in parallel with the rotation axis according to image data, and a latent image is formed on the surface of the photosensitive drum 32, as regions where the latent image is formed gains a lower potential due to an effect of the laser beam. As the photoconductive drum 32 with the latent image on the surface thereof is rotated, the toner positively charged on the surface of the developing roller 34 is transferred and adhered to the lower-potential region, which corresponds to the latent image on the surface of the photosensitive drum 32. Thus, the latent image is developed to be a reverse image.

The fixing unit 40 is disposed on a downstream side of the sheet feeding path 19 with respect to the process cartridge 30. The fixing unit 40 includes a heat roller 41 with a heat source (not shown) and a pressure roller 42, which is pressed to be in contact with the heat roller 41. The toner image transferred onto the recording sheet 3 in the process cartridge 30 is thermally fixed thereto when the recording sheet 3 is fed between the heat roller 41 and the pressure roller 42. The recording sheet 3 fed along a discharging path 44 is passed to a pair of discharge rollers 45 to be discharged out of the laser printer 1. The discharged recording sheet 3 is received by a discharge tray 46.

Next, configuration of the feeder unit 4 will be described in detail. The feed roller 61 and the separator roller 62 are respectively provided with a feed roller gear 61*a* and a separator roller gear 62*a*, which are respectively rotatable integrally with the feed roller 61 and the separator roller 62. The feed roller gear 61*a* and the separator roller gear 62*a* are engaged via an idle gear 63*a* and rotate substantially synchronously in a same direction.

Figure 2:
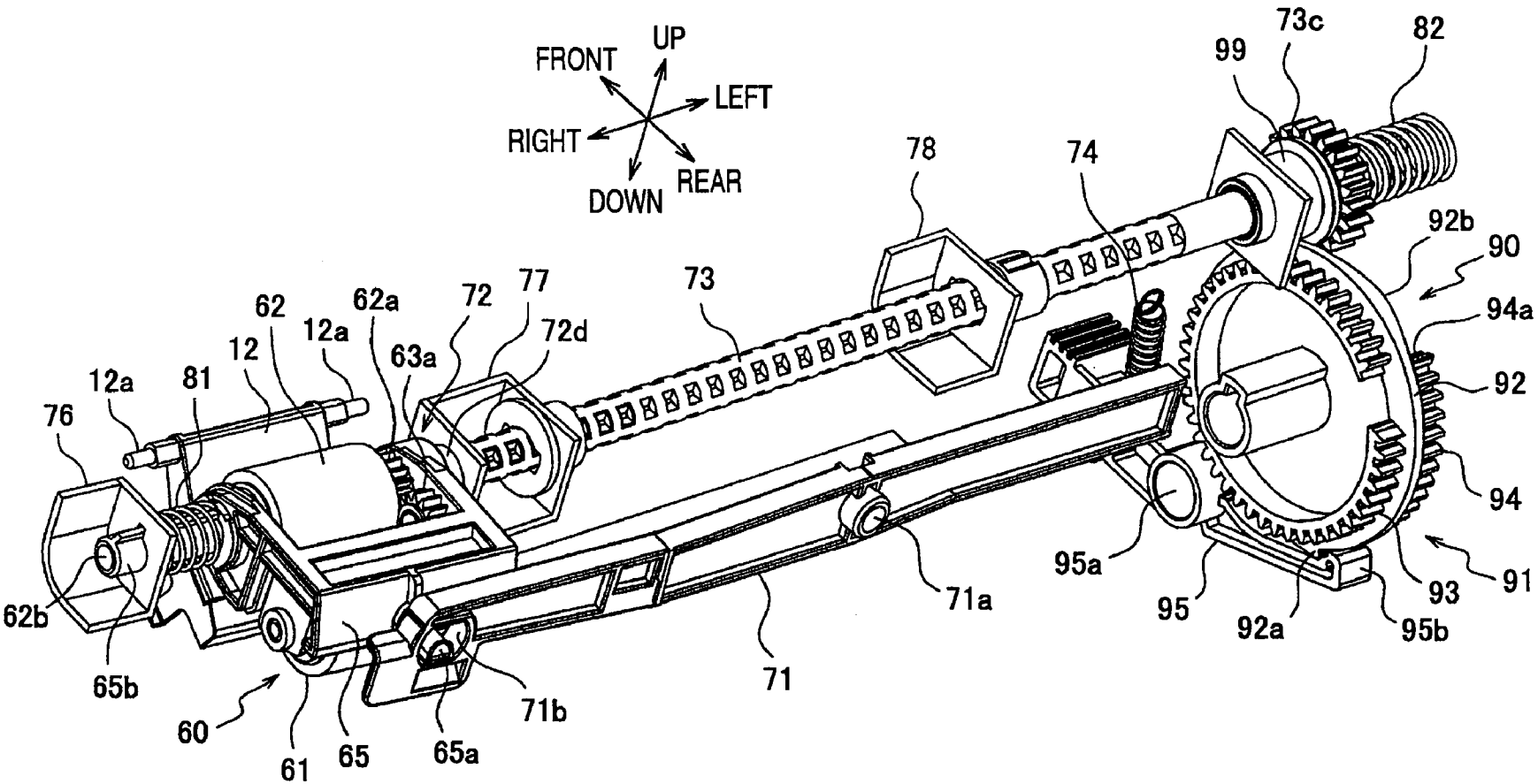
FIG. 2 is a perspective view of a sheet feeder assembly in a feeder unit according to the embodiment of the present invention.

The feed roller 61, the feed roller gear 61*a*, the separator roller 62, the separator roller gear 62*a*, and the idle gear 63*a*, and a roller holder 65 are included in a feed roller assembly 60, and the roller holder 65 rotatably supports the feed roller 61, the separator roller 62, and the idle gear 63*a*. FIG. 2 is a perspective view of the feed roller assembly 60 in the feeder unit 4 according to the embodiment of the present invention. It is to be noted that a right-hand side in FIG. 2 corresponds to a right end of the laser printer 1, and a left-hand side in FIG. 2 corresponds to a left end of the laser printer 1, as indicated by arrows in FIG. 2. The roller holder 65 is rotatable about a rotation shaft 62*b* of the separator roller 62, and one end of the roller holder 65 close to the feeder roller 61 is connected with the right end of a lifting arm 71, which will be described later in detail. The separator roller 62 is coupled to a separator roller driving shaft 73 through a universal joint 72. The separator roller driving shaft 73 is rotated by a gear assembly 90, which is arranged on the left end of the sheet tray 11.

The lifting arm 71 is swingably supported by the main body of the laser printer 1 at a fulcrum point 71*a*, which is at an approximate center of the lifting arm 71. The lifting arm 71 is formed to have an opening 71*b*, in which a projection 65*a* of the roller holder 65 is inserted, on the right end thereof. The lifting arm 71 is further provided with a tension coil spring 74 in the vicinity of the left end thereof, which pulls the lifting arm 71 upward. By effects of the tensile force by the tension coil spring 74 and a weight of the feed roller assembly 60, the lifting arm 71 is biased to rotate about the fulcrum point 71*a* in the counterclockwise direction in FIG. 2 (i.e., the right end being downward). According to the biasing force, the feed roller 61 is pressed onto the topmost recording sheet in the sheet stack held by the holder plate 51.

Figure 3:
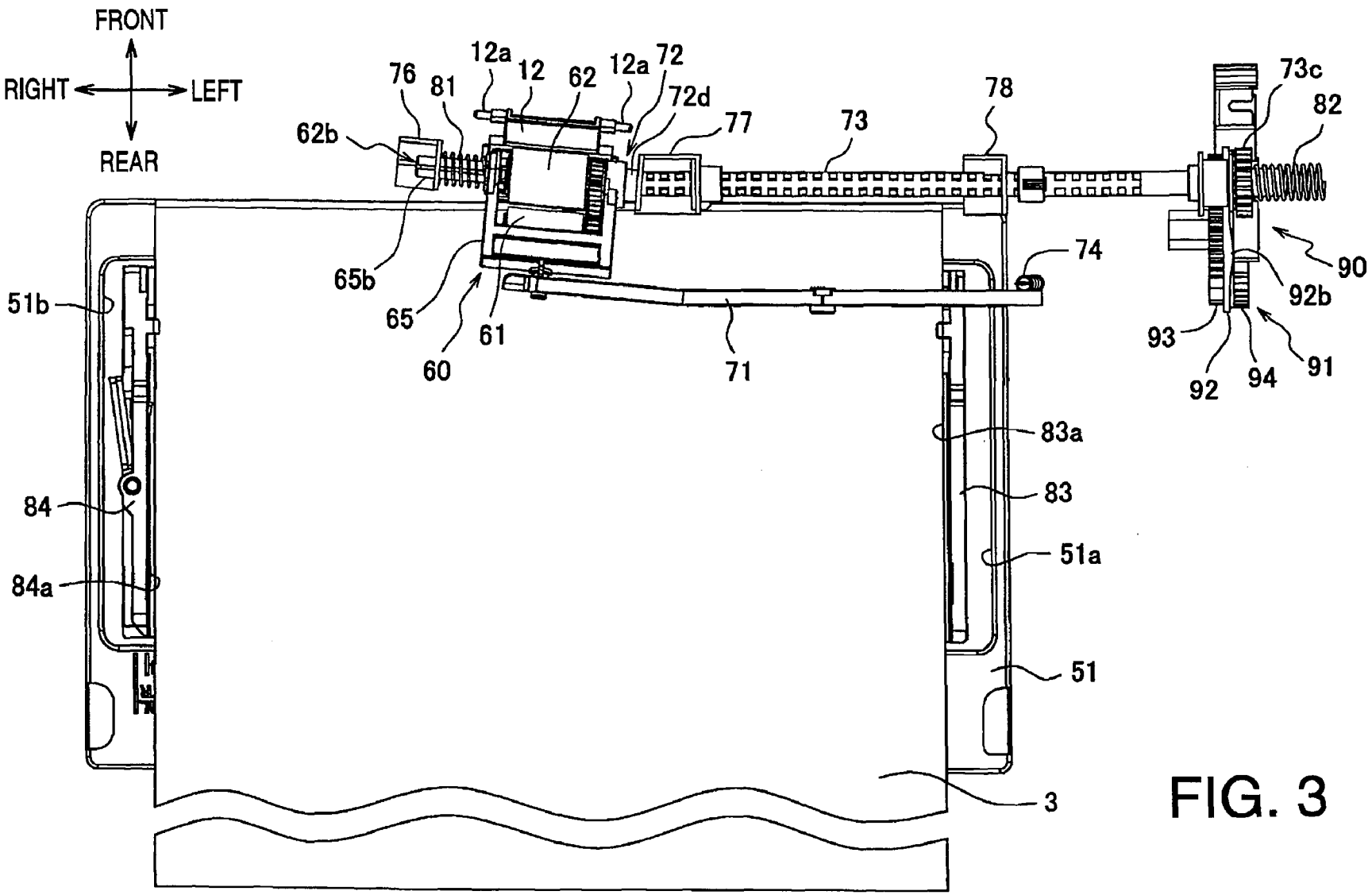
FIG. 3 is a plane view of a sheet tray of the laser printer with a sheet feeder assembly according to the embodiment of the present invention.

The separator roller 62 and the separator roller driving shaft 73 are held by bearing holders 76, 77, and 78, which are attached to a frame (not shown) of the main body to support the image forming unit 5. While being held by the bearing holders 76, 77, and 78, the separator roller 62 and the separator roller driving shaft 73 are rotatable about an axis and slidable in a longitudinal direction in the bearing holders 76, 77, and 78. FIG. 3 is a plane view of the sheet tray 11 with the feed roller assembly 60 according to the embodiment of the present invention. As shown in FIG. 3, the separator roller driving shaft 73 is arranged in the right-left direction (i.e., a widthwise direction of the recording sheet). Meanwhile, the feed roller 61 and the separator roller 62 are oriented to have the left ends thereof being angled toward the front. The bearing holder 76 is provided in an angled position toward the front with respect to the bearing holders 77, 78 and holds a bearing 65*b*, which rotatably supports the rotation shaft 62*b* of the separator roller 62. The bearing holder 78 rotatably and slidably supports the separator roller driving shaft 73 at an approximately center thereof. The bearing holder 77 rotatably and slidably supports the separator roller driving shaft 73 at an approximate right end thereof. The bearing holder 77 further rotatably and slidably supports the rotation shaft 62*b* of the separator roller 62 at an engageable portion 72*d*.

Figure 4A:
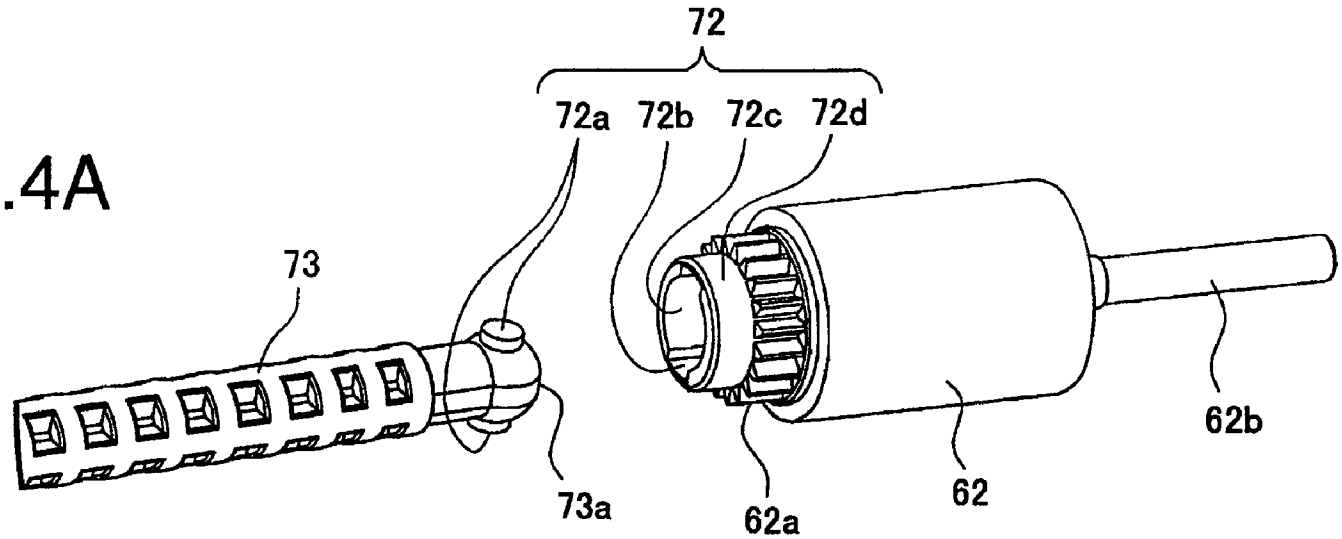
FIGS. 4A and 4B are exploded view of a universal joint in the sheet feeder assembly according to the embodiment of the present invention.
Figure 4B:
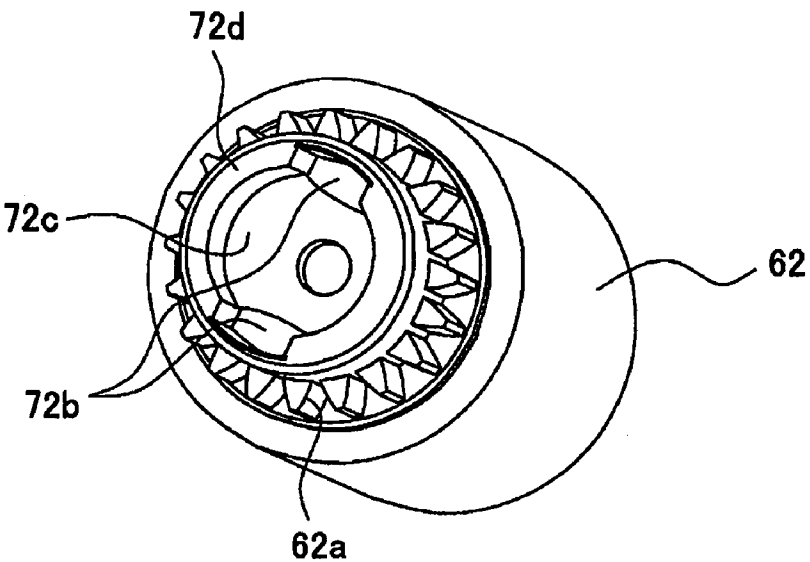

Configuration of the universal joint 72 will be described with reference to FIGS. 4A and 4B. FIGS. 4A and 4B are exploded view of the universal joint 72 in the feed roller assembly 60 according to the embodiment of the present invention. The universal joint 72 includes a pair of projections 72*a*, which are provided on an outer periphery of a right-end portion 73*a* of the separator roller driving shaft 73 to be apart from each other approximately at 180 degrees, and the engageable portion 72*d*, which is formed integrally on the left end of the rotation shaft 62*b*. The engageable portion 72*d* includes a pair of grooves 72*b*, to which the projections 72*a* are respectively inserted, and a recess 72*c* to receive a tip end of the right-end portion 73*a*.

According to the above configuration, when the projections 72*a* are inserted in the grooves 72*b*, rotation of the separator roller driving shaft 73 is conveyed to the separator roller 62. The engageable portion 72*d* is held by the bearing holder 77 to be rotatable about the rotation shaft 62*b* and slidable in the axial direction of the rotation shaft 62*b*. The bearing holders 77, 78 are formed to have openings, through which the separator roller driving shaft 73 is penetrated. The openings are formed to have shapes of ovals, with longitudinal sides being parallel with each other, so that the separator roller driving shaft 73 is movable in parallel with the longitudinal sides (see FIG. 2). A position of the right-end portion of the separator roller driving shaft 73 is defined by the universal joint 72.

The feed roller assembly 60 is biased toward the universal joint 72 by a compression coil spring 81, which is provided between a right side of the roller holder 65 and the bearing holder 76 (see FIGS. 2 and 3). Further, the separator roller driving shaft 73 is provided with a separator roller driving gear 73, which rotates integrally with the separator roller driving shaft 73 at the left end thereof, and the separator roller driving shaft 73 is biased toward the universal joint 72 by a compression coil spring 82 at the left side of the separator roller driving gear 73. The compression force of the compression coil spring 82 is configured to be greater than the compression force of the compression coil spring 81 so that the separator roller driving shaft 73 and the feed roller assembly 60 are biased overall toward the right.

Further, the sheet tray 11 is provided with guides 83, 84 at the bottom, which protrudes through holes 51*a*, 51*b* respectively formed on the holder plate 51 to project from the holder plate 51 (see FIG. 3). The guide 83 is fixed to the bottom of the sheet tray 11 and includes a guide surface 83*a*, with which a left side end of the recording sheet 3 is in contact to guide the recording sheet 3 in the sheet feeding path. The guide 84 is provided to the sheet tray 11 and slidable in the right-left direction. The guide 84 includes a guide surface 84*a*, with which a right side end of the recording sheet 3 is in contact to guide the recording sheet 3 in the sheet feeding path. Furthermore, the separator pad 12 is provided with shaft portions 12*a*, which extend from the both ends of the separator pad 12 in order to swingably support the separator pad 12. The shaft portions 12*a* are arranged to be parallel with the rotation shaft 62*b* of the separator roller 62. Thus, the separator pad 12 can become in line-contact with the surface of the separator roller 62.

Figure 5:
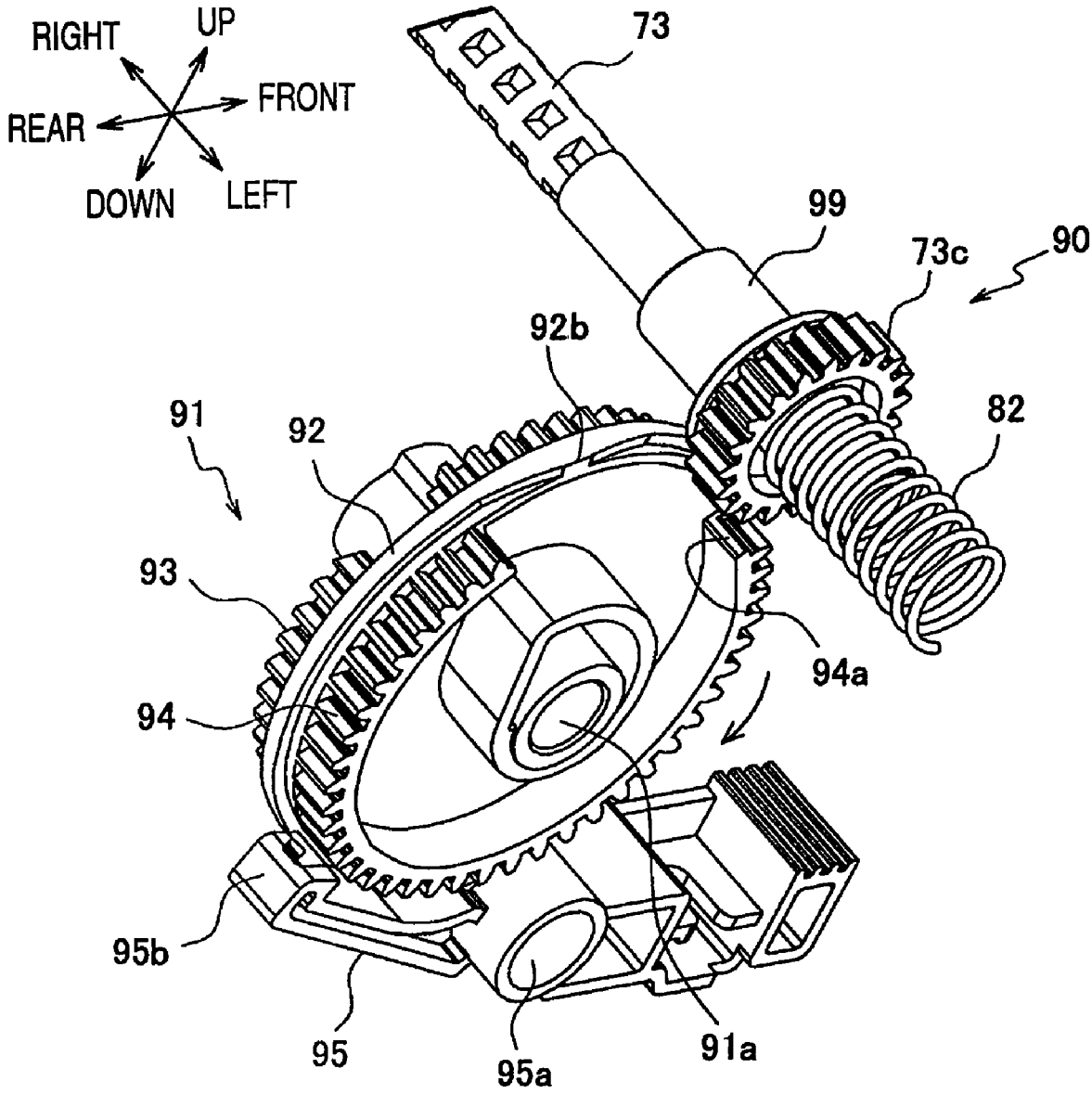
FIG. 5 is a perspective view of a gear assembly in a feeder unit according to the embodiment of the present invention.

Next, the gear assembly 90 will be described with reference to FIG. 5. FIG. 5 is a perspective view of the gear assembly 90 to drive the separator roller driving shaft 73 according to the embodiment of the present invention. The gear assembly 90 is provided with a sector gear 91 to be rotated about a shaft hole 91*a*, into which a shaft (not shown) extending in the right-left direction is fitted. The sector gear 91 includes a substantially disk-shaped cam 92, an input gear 93 formed on a right side of the cam 92, to which driving force from a driving system (not shown) is conveyed, and an output gear 94 formed on a left side of the cam 92, which conveys the driving force provided through the input gear 93 to the separator roller driving gear 73*c*. The output gear 94 is not formed on an entire circumference corresponding to the circumference of the disk-shape of the cam 92, but is formed to have a teeth-absent portion 94*a*, in which no tooth to convey the driving force of the cam 92 is provided. Therefore, when the separator roller driving gear 73*c* is rotated to meet the teeth-absent portion 94*a*, the driving force from the input gear 93 is not conveyed to the separator roller driving gear 73*c* so that the feed roller 61 and the separator roller 62 can be rotated without being affected by the separator roller driving shaft 73.

The cam 92 is formed to have a stopper projection 92*a* (see FIG. 2) on the circumference thereof so that rotation of the sector gear 91 is stopped thereby when the stopper projection 92*a* is engaged with a solenoid-operable lever 95, which is provided underneath the sector gear. The solenoid-operable lever 95 is formed to have an engaging portion 95*b*, which can be engaged with the stopper projection 92*a* to stop rotation of the sector gear 91 when the solenoid-operable lever 95 is rotated about a shaft hole 95*a* in the counterclockwise direction in FIG. 2 by a solenoid (not shown) to be in a ready position. When the solenoid-operable lever 95 is rotated in the clockwise direction, the stopper projection 92*a* is released, and the sector gear 91 is allowed to rotate.

The cam 92 is further formed to have a convex 92*b*, which projects leftward, on a portion on the circumference and corresponding to the teeth-absent portion 94*a* of the output gear 94. When the convex 92*b* becomes in contact with a cam-follower sleeve 99, which is coupled to the separator roller driving shaft 73, and presses the separator roller driving gear 73*c* leftward, the separator roller driving shaft 73 along with the feed roller assembly 60 is displaced leftward against the expanding force of the compression coil spring 82.

Next, movements of the gear assembly 90 and effects caused by the movements will be described in detail. When the engaging portion 95*b* of the solenoid-operable lever 95 is in the ready position to be engaged with the stopper projection 92*a* (see FIG. 5), the teeth-absent portion 94*a* is in a position to confront the separator roller driving gear 73*c*, and the convex 92*b* of the cam 92 is not in contact with the cam-follower sleeve 99. When a sheet feeding operation starts, the sector gear 91 is rotated in the clockwise direction, which is indicated by an arrow in FIG. 5. Accordingly, the convex 92*b* comes in contact with the cam-follower sleeve 99 so that the separator roller driving shaft 73 and the feed roller assembly 60 are shifted leftward from the biased positions according to the displacement of the cam-follower sleeve 99. In this regard, the feed roller 61 and the separator roller 62 are pressed onto the surface of the recording sheet 3 due to the tensile force of the tension coil spring 74. Therefore, the topmost recording sheet 3 can be distinctly separated from the sheet stack in the sheet tray 11 by the feed roller 61 and the separator roller 62, which are slid leftward on the topmost recording sheet 3 and urge the topmost recording sheet 3 against the guide surface 83*a*.

When the cam 92 is rotated further and the convex 92*b* passes by the separator roller driving gear 73*c*, the separator roller driving shaft 73 and the feed roller assembly 60 return to the biased positions. Further, the output gear 94 is engaged with the separator roller driving gear 73*c*. Accordingly, the feed roller 61 and the separator roller 62 are rotated by the driving force conveyed through the separator roller driving shaft 73. In this regard, it is to be noted that the feed roller 61 and the separator roller 62 are oriented to have the left ends thereof being angled toward the front; thus, a direction in which the feed roller 61 feeds the recording sheet 3 and a direction in which the separator roller 62 transports the recording sheet 3 are identical and angled toward the guide surface 83*a* with respect to a direction parallel with the guide surface 83*a*. Therefore, the feed roller 61 and the separator roller 62 can again urge the recording sheet 3 to the guide surface 83*a* to separate from the sheet stack in the sheet tray so that a successive recording sheet in the sheet stack can be prevented from being fed along with the topmost recording sheet 3. Further, a direction, in which the separator pad 12 provides the resistance to separate the successive recording sheet from the topmost recording sheet 3, is opposite from the direction in which the separator roller 62 forwards the topmost recording sheet 3. Thus, the recording sheet 3 can be effectively separated from the successive sheet by the cooperative effect of the movements of the separator roller 62 and the separator pad 12.

According to the above embodiment, the recording sheet 3 can be distinctly separated from the sheet stack and fed in the image forming unit 5. Further, when the feed roller 61 and the separator roller 62 are shifted in the right-left direction, the separator roller driving gear 73*c* confronts the teeth-absent portion 94*a* of the output gear 94 so that the feed roller 61 and the separator roller 62 are released from the rotating force of the separator roller driving shaft 73. Therefore, the feed roller 61 and the separator roller 62 can travel on the recording sheet 3 easily so that the topmost recording sheet 3 can be separated from the sheet stack even more effectively.

Although an example of carrying out the invention has been described, those skilled in the art will appreciate that there are numerous variations and permutations of the sheet feeding device and an image reading apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiment, the separator roller driving shaft 73 is shifted in the direction perpendicularly to the sheet feeding direction by the cam-follower sleeve 99 pressed onto the side of the cam 92. However, the cam 92, which is a face cam as shown in FIG. 2, can be replaced with a grooved cam.

For another example, the separator roller driving shaft 73 can be replaced with another configuration that can be embedded in, for example, the lifting arm 71. Furthermore, the sheet feeding device may not necessarily be installed in the image forming apparatus, but may be configured independently from the image forming apparatus. Moreover, the sheet feeding device may be a device to feed sheets in an apparatus other than an image forming apparatus.

What is claimed is:

1. A sheet feeding device to feed a sheet in a sheet stack into a sheet feeding path, comprising:

a feed roller configured to contact the sheet stack and feed the sheet in a feeding direction;

a guide member, having a guide surface, which is configured to contact a side of the sheet fed by the feed roller, to guide the sheet being fed along a guiding direction, such that the feeding direction is inclined with respect to the guiding direction;

a shifting unit to shift the feed roller in a direction toward the guide surface before the feed roller is rotated;

a separator roller to separate the sheet fed by the feed roller from the sheet stack and forward the sheet to the guide member; and a separator piece, which is arranged in a position to become in contact with the sheet fed by the feed roller on a surface opposite from a surface being in contact with an outer peripheral surface of the separator roller so that resistance is generated between the separator piece and the sheet being forwarded by the separator roller, wherein the feeding direction and a direction in which the separator roller forwards the sheet are parallel, wherein the direction in which the separator roller forwards the sheet is inclined with respect to the guiding direction, and wherein the shifting unit shifts the feed roller along with the separator roller in the direction toward the guide surface before the feed roller is rotated.

2. The sheet feeding device according to claim 1, wherein the shifting unit includes:

a cam, which has a convex portion and is configured to rotate along with a first gear;

a cam-follower configured to be in contact with the cam and displaceable by the convex portion of the cam; and a coupling member coupled to the cam-follower and configured to shift the feed roller according to the displacement of the cam-follower.

3. The sheet feeding device according to claim 2, wherein the first gear is a sector gear including a teeth-absent portion; and wherein the convex portion of the cam is formed in a position to become in contact with the cam-follower when the teeth-absent portion of the first gear confronts a second gear, which is coupled to the feed roller and transfers driving force from the first gear to the feed roller.

4. The sheet feeding device according to claim 3, wherein the convex portion of the cam is formed in a position corresponding to the teeth-absent portion of the first gear to shift the cam-follower toward the guide surface when the teeth-absent portion of the first gear confronts the second gear.

5. An image forming apparatus, comprising:

a sheet feeding device to feed a sheet in a sheet stack into a sheet feeding path; and an image forming unit to form the image on the sheet being fed by the sheet feeding device, wherein the sheet feeding device includes:

a feed roller configured to contact the sheet stack and feed the sheet in a feeding direction;

a guide member, having a guide surface, which is configured to contact a side of the sheet fed by the feed roller, to guide the sheet being fed along a guiding direction, such that the feeding direction is inclined with respect to the guiding direction;

a shifting unit to shift the feed roller in a direction toward the guide surface before the feed roller is rotated;

a separator roller to separate the sheet fed by the feed roller from the sheet stack and forward the sheet to the guide member;

a separator piece, which is arranged in a position to become in contact with the sheet fed by the feed roller on a surface opposite from a surface being in contact with an outer peripheral surface of the separator roller so that resistance is generated between the separator piece and the sheet being forwarded by the separator roller, wherein the feeding direction and a direction in which the separator roller forwards the sheet are parallel, wherein the direction in which the separator roller forwards the sheet is inclined with respect to the guiding direction. and wherein the shifting unit shifts the feed roller along with the separator roller in the direction toward the guide surface before the feed roller is rotated.

6. The sheet feeding device according to claim 5, wherein the shifting unit includes:

a cam, which has a convex portion and is configured to rotate along with a first gear;

a cam-follower configured to be in contact with the cam and displaceable by the convex portion of the cam; and a coupling member coupled to the cam-follower and configured to shift the feed roller according to the displacement of the cam-follower.

7. The sheet feeding device according to claim 6, wherein the first gear is a sector gear including a teeth-absent portion; and wherein the convex portion of the cam is formed in a position to become in contact with the cam-follower when the teeth-absent portion of the first gear confronts a second gear, which is coupled to the feed roller and transfers driving force from the first gear to the feed roller.

8. The sheet feeding device according to claim 7, wherein the convex portion of the cam is formed in a position corresponding to the teeth-absent portion of the first gear to shift the cam-follower toward the guide surface when the teeth-absent portion of the first gear confronts the second gear.

9. A sheet feeding device to feed a sheet in a sheet stack into a sheet feeding path, comprising:

a feed roller configured to contact the sheet stack and feed the sheet in a feeding direction;

a guide member, having a guide surface, which is configured to contact a side of the sheet fed by the feed roller, to guide the sheet being fed along a guiding direction, such that the feeding direction is inclined with respect to the guiding direction; and a shifting unit to shift the feed roller in a direction toward the guide surface before the feed roller is rotated, wherein the shifting unit includes:

a cam, which has a convex portion and is configured to rotate along with a first gear;

a cam-follower configured to be in contact with the cam and displaceable by the convex portion of the cam; and a coupling member coupled to the cam-follower and configured to shift the feed roller according to the displacement of the cam-follower.

10. The sheet feeding device according to claim 9, further comprising:

a separator roller to separate the sheet fed by the feed roller from the sheet stack and forward the sheet to the guide member;

a separator piece, which is arranged in a position to become in contact with the sheet fed by the feed roller on a surface opposite from a surface being in contact with an outer peripheral surface of the separator roller so that resistance is generated between the separator piece and the sheet being forwarded by the separator roller, wherein the feeding direction and a direction in which the separator roller forwards the sheet are parallel; and wherein the direction in which the separator roller forwards the sheet is inclined with respect to the guiding direction.

11. The sheet feeding device according to claim 10, wherein the shifting unit shifts the feed roller along with the separator roller in the direction toward the guide surface before the feed roller is rotated.

12. The sheet feeding device according to claim 9, wherein the first gear is a sector gear including a teeth-absent portion, and wherein the convex portion of the cam is formed in a position to become in contact with the cam-follower when the teeth-absent portion of the first gear confronts a second gear, which is coupled to the feed roller and transfers driving force from the first gear to the feed roller.

13. The sheet feeding device according to claim 12, wherein the convex portion of the cam is formed in a position corresponding to the teeth-absent portion of the first gear to shift the cam-follower toward the guide surface when the teeth-absent portion of the first gear confronts the second gear.

14. An image forming apparatus, comprising:

a sheet feeding device to feed a sheet in a sheet stack into a sheet feeding path; and an image forming unit to form the image on the sheet being fed by the sheet feeding device, wherein the sheet feeding device includes:

a feed roller configured to contact the sheet stack and feed the sheet in a feeding direction;

a guide member, having a guide surface, which is configured to contact a side of the sheet fed by the feed roller, to guide the sheet being fed along a guiding direction, such that the feeding direction is inclined with respect to the guiding direction;

a shifting unit to shift the feed roller in a direction toward the guide surface before the feed roller is rotated, wherein the shifting unit includes:

a cam, which has a convex portion and is configured to rotate along with a first gear;

a cam-follower configured to be in contact with the cam and displaceable by the convex portion of the cam; and a coupling member coupled to the cam-follower and configured to shift the feed roller according to the displacement of the cam-follower.

15. The sheet feeding device according to claim 14, further comprising:

a separator roller to separate the sheet fed by the feed roller from the sheet stack and forward the sheet to the guide member; and a separator piece, which is arranged in a position to become in contact with the sheet fed by the feed roller on a surface opposite from a surface being in contact with an outer peripheral surface of the separator roller so that resistance is generated between the separator piece and the sheet being forwarded by the separator roller, wherein the feeding direction and a direction in which the separator roller forwards the sheet are parallel, and wherein the direction in which the separator roller forwards the sheet is inclined with respect to the guiding direction.

16. The sheet feeding device according to claim 15, wherein the shifting unit shifts the feed roller along with the separator roller in the direction toward the guide surface before the feed roller is rotated.

17. The sheet feeding device according to claim 14, wherein the first gear is a sector gear including a teeth-absent portion; and wherein the convex portion of the cam is formed in a position to become in contact with the cam-follower when the teeth-absent portion of the first gear confronts a second gear, which is coupled to the feed roller and transfers driving force from the first gear to the feed roller.

18. The sheet feeding device according to claim 17, wherein the convex portion of the cam is formed in a position corresponding to the teeth-absent portion of the first gear to shift the cam-follower toward the guide surface when the teeth-absent portion of the first gear confronts the second gear.

19. A sheet feeding device to feed a sheet in a sheet stack along a sheet feeding path, comprising:

a feed roller configured to contact the sheet stack and feed the sheet;

a guide member having a guide surface, the guide member being configured to contact a side of the sheet fed by the feed roller to guide the sheet being fed along a guiding direction; and a shifting unit to shift the feed roller in a direction toward the guide surface, wherein the shifting unit comprises:

a cam;

a first gear configured to rotate the cam;

a coupling shaft;

a second gear configured to mesh with the first gear; and a cam-follower configured to be displaceable according to the rotation of the cam, wherein the coupling shaft couples the cam, the second gear, and the feed roller with one another.

20. The sheet feeding device according to claim 19, wherein the coupling shaft is configured to be movable in a direction along the rotating axis of the coupling shaft, wherein the coupling shaft is coupled to the cam and the second gear at a first end thereof and to the feed roller at a second end thereof, and wherein the coupling shaft is configured to rotate the feed roller according to the rotation of the second gear, and is configured to shift the feed roller when the cam-follower is displaced by the cam and the coupling shaft slides along the rotating axis of the coupling shaft.

21. The sheet feeding device according to claim 20, wherein the coupling shaft is coupled to the feed roller at the second end thereof via a universal joint, and wherein the rotation axis of the feed roller is inclined with respect to the rotation axis of the coupling shaft.

22. The sheet feeding device according to claim 20, further comprising:

a separator roller for separating the sheet fed by the feed roller from the sheet stack and forwarding the sheet; and a transferring mechanism for transferring a driving force from the coupling shaft to the separator roller.

* * * * *